US009372459B2

(12) United States Patent
Amada

(10) Patent No.: US 9,372,459 B2
(45) Date of Patent: Jun. 21, 2016

(54) IMAGE FORMING APPARATUS FOR FORMING IMAGES USING DIFFERENT DEVELOPER

(71) Applicant: OKI DATA CORPORATION, Tokyo (JP)

(72) Inventor: Daitetsu Amada, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/219,024

(22) Filed: Mar. 19, 2014

(65) Prior Publication Data

US 2014/0286664 A1 Sep. 25, 2014

(30) Foreign Application Priority Data

Mar. 19, 2013 (JP) ..... 2013-056939

(51) Int. Cl.
*G03G 15/20* (2006.01)
*G03G 15/23* (2006.01)

(52) U.S. Cl.
CPC .... *G03G 15/235* (2013.01); *G03G 2215/00945* (2013.01); *G03G 2215/00949* (2013.01); *G03G 2215/0129* (2013.01); *G03G 2215/0196* (2013.01); *G03G 2215/2045* (2013.01)

(58) Field of Classification Search
CPC ..... G03G 15/235; G03G 2215/00945; G03G 2215/2045; G03G 2215/0129; G03G 2215/0196; G03G 2215/00949
USPC ..... 399/68, 67
See application file for complete search history.

(56) References Cited

U.S. PATENT DOCUMENTS

2011/0008086 A1 * 1/2011 Matsudaira et al. ..... 399/341

FOREIGN PATENT DOCUMENTS

| | | | | |
|---|---|---|---|---|
| JP | H07-325511 | A | | 12/1995 |
| JP | 2002-328501 | A | | 11/2002 |
| JP | 2006-078883 | A | | 3/2006 |
| JP | 2009-145376 | A | | 7/2009 |
| JP | 2009145376 | A | * | 7/2009 |
| JP | 2010-250055 | A | | 11/2010 |

* cited by examiner

*Primary Examiner* — Billy Lactaoen
(74) *Attorney, Agent, or Firm* — Kubotera & Associates, LLC

(57) ABSTRACT

An image forming apparatus includes a developer image forming portion configured to form a developer image on a recording medium; a fixing portion configured to fix the developer image to the recording medium; a transportation portion configured to transport the recording medium to form a second image on the recording medium; and a transportation speed setting portion configured to set a transportation speed of the recording medium when the fixing portion fixes the developer image to the recording medium. The transportation speed setting portion sets a first transportation speed when the first image is fixed to the recording medium and a second transportation speed when the second image is fixed to the recording medium according to first developer used for forming the first image and second developer used for forming the second image. The first transportation speed is different from the second transportation speed.

6 Claims, 6 Drawing Sheets

IMAGE FORMING APPARATUS FOR FORMING IMAGES USING DIFFERENT DEVELOPER

BACKGROUND OF THE INVENTION AND RELATED ART STATEMENT

The present invention relates to an image forming apparatus that performs a thermal fixing operation. More specifically, the present invention relates to an image forming apparatus that performs a plurality of transfer and fixing operations on a same recording medium.

When a conventional image forming apparatus performs a printing operation, for example, toner images in colors of magenta, cyan, yellow, and black are sequentially overlapped to form a color image on a recording medium, and the color image is fixed to the recording medium. Afterward, in order to obtain a text image with gloss image quality, a transparent toner image is overlapped and transferred to the color image in a later stage, and the transparent toner image is fixed (refer to Patent Reference). In the following description, such an operation, in which the transfer operation and the fixing operation are performed twice on a same surface of a same recording medium, may be referred to as a two-pass printing operation.

Patent Reference: Japanese Patent Publication No. 2010-250055

In the conventional image processing system disclosed in Patent Reference, when the transfer operation and the fixing operation are performed twice using the different types of developer, i.e., color toner and transparent toner, there may be a problem due to various fixing properties according to developer.

An object of the present invention is to provide an image forming apparatus capable of solving the problems.

Further objects and advantages of the invention will be apparent from the following description of the invention.

SUMMARY OF THE INVENTION

In order to attain the objects described above, according to an aspect of the present invention, an image forming apparatus includes a developer image forming portion configured to form a developer image on a recording medium; a fixing portion configured to fix the developer image to the recording medium; a transportation portion configured to transport the recording medium to the developer image forming portion and the fixing portion to form a second image on the recording medium after the developer image forming portion and the fixing portion form a first image on the recording medium; and a transportation speed setting portion configured to set a transportation speed of the recording medium when the fixing portion fixes the developer image to the recording medium.

According to the aspect of the present invention, the transportation speed setting portion sets a first transportation speed when the first image is fixed to the recording medium and a second transportation speed when the second image is fixed to the recording medium according to first developer used for forming the first image and second developer used for forming the second image. The first transportation speed is different from the second transportation speed.

According to the present invention, it is possible to separately set the first transportation speed in fixing and transferring the first image to the recording medium and the second transportation speed in fixing and transferring the second image to the recording medium respectively according to the first developer and the second developer. Accordingly, it is possible to prevent a fixing problem.

DETAILED DESCRIPTION OF PREFERRED EMBODIMENTS

First Embodiment

Figure 1:
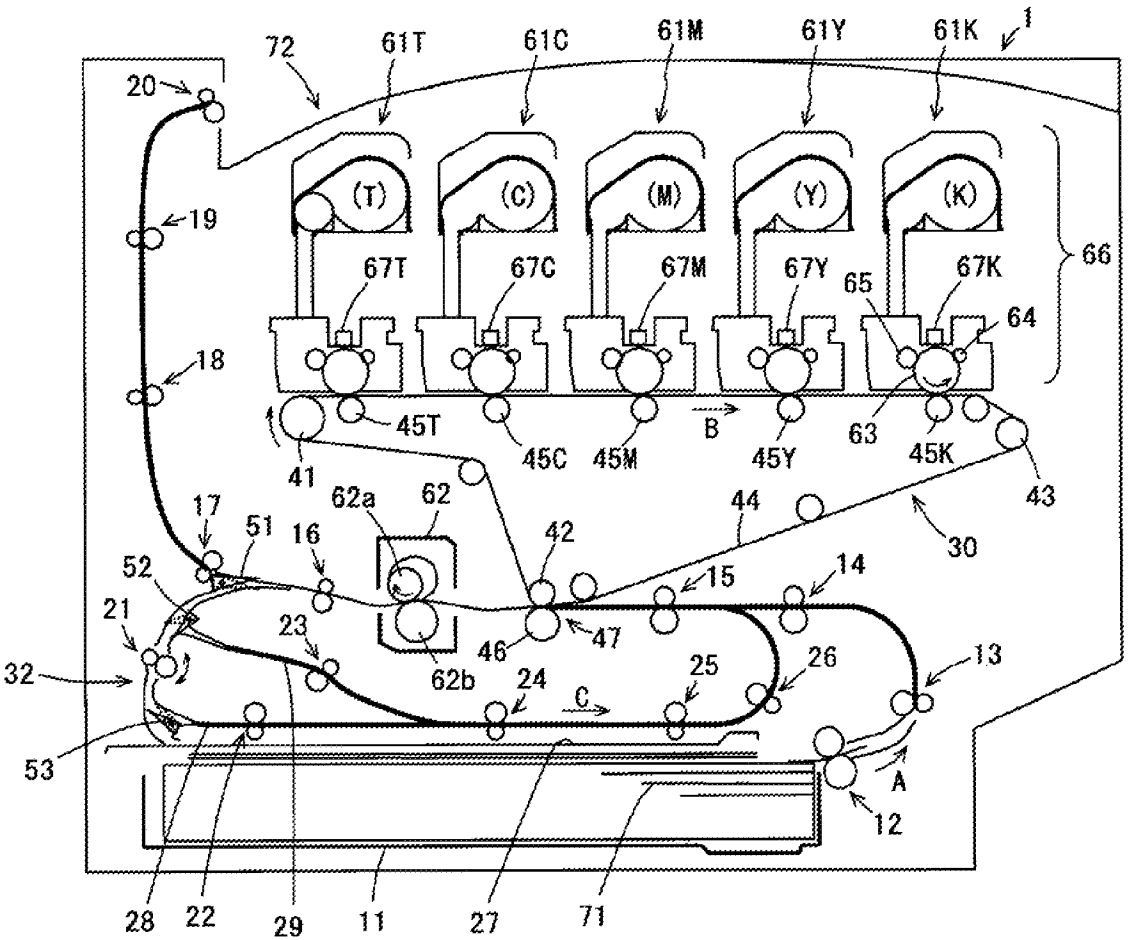
FIG. 1 is a schematic sectional view showing a configuration of a printer according to a first embodiment of the present invention.

A first embodiment of the present invention will be explained. FIG. 1 is a schematic sectional view showing a configuration of a printer 1 as an image forming apparatus according to the first embodiment of the present invention.

In the first embodiment, the printer 1 is configured as a color electro-photographic printer of an intermediate transfer type capable of printing five colors of black (K), yellow (Y), magenta (M), cyan (C), and transparent (T). As shown in FIG. 1, the printer 1 includes a sheet supply cassette 11; a sheet supply roller pair 12; register roller pairs 13 and 14; and a timing roller pair 15. The sheet supply cassette 11 is provided for retaining a recording sheet 71 as a recording medium in a stacked state therein. The sheet supply roller pair 12 is provided for picking up the recording sheet 71 from the sheet supply cassette 11 one by one, and for sequentially supplying the recording sheet 71 to a transportation path. The register roller pairs 13 and 14 are disposed on a downstream side of the sheet supply cassette 11 in an arrow direction A indicating a transportation direction of the recording sheet 71 for collecting a skew of the recording sheet 71. The timing roller pair 15 is disposed on a downstream side of the register roller pairs 13 and 14 for supplying the recording sheet 71 to a secondary transfer portion 47 at a specific timing.

In the first embodiment, the printer 1 further includes an image forming portion 66 for forming toner images in colors of black (K), yellow (Y), magenta (M), cyan (C), and transparent (T). The forming portion 66 has five image drum units 61T, 61C, 61M, 61Y, and 61K (in the following description, referred to as ID units) and five LED heads 67T, 67C, 67M, 67Y, and 67K. When it is not necessary to differentiate colors, the image drum units 61T, 61C, 61M, 61Y, and 61K are simply referred to as ID units 61, and the LED heads 67T, 67C, 67M, 67Y, and 67K are simply referred to as LED heads 67.

In the first embodiment, the ID units 61T, 61C, 61M, 61Y, and 61K are arranged sequentially in this order from an upstream side along an arrow direction B, indicating a movement direction of an intermediate transfer belt 44 of an intermediate transfer belt unit 30 (described later). The five LED units 67T, 67C, 67M, 67Y, and 67K are arranged to face each of the ID units 61T, 61C, 61M, 61Y, and 61K, so that each of the LED units 67T, 67C, 67M, 67Y, and 67K irradiates light on a specific portion of a photosensitive drum 63 disposed in the ID unit 61 (described later).

In the first embodiment, the ID units 61T, 61C, 61M, 61Y, and 61K have a similar internal configuration. Accordingly, in the following description, the internal configuration of the ID unit 61K of black (K) will be explained as an example.

In the first embodiment, the photosensitive drum 63 is disposed in the ID unit 61K to be rotatable in an arrow direction. Surrounding the photosensitive drum 63, there are provided in this order from an upstream side of a rotational direction of the photosensitive drum 63, a charging roller 64 for supplying electric charges to a surface of the photosensitive drum 63 to charge the surface of the photosensitive drum 63; the LED head 67K for selectively irradiating light on the surface of the photosensitive drum 63 to form a static latent image thereon; and a developing roller 65 for attaching toner to the surface of the photosensitive drum 63 where the static latent image is formed to develop the static latent image. It should be noted that a driving force is transmitted from a drive source (not shown) to the drums and the rollers through a gear and the like, so that the drums and the rollers are rotated.

In the first embodiment, the intermediate transfer belt unit 30 includes a drive roller 41 driven by the drive source (not shown); a tension roller 43 for applying tension to an intermediate transfer belt 44; a secondary transfer backup roller 42 arranged to face a secondary transfer roller 46 and constituting a secondary transfer portion 79; and the intermediate transfer belt 44 extended by the rollers. Further, the intermediate transfer belt unit 30 includes five primary transfer rollers 45T, 45*c*, 45*m*, 45*y*, and 45*k*. When it is not necessary to differentiate colors, the primary transfer rollers 45T, 45*c*, 45*m*, 45*y*, and 45*k* are simply referred to as primary transfer rollers 45. The primary transfer rollers 45T, 45*c*, 45*m*, 45*y*, and 45*k* are provided for applying a specific voltage, so that each toner image formed on each of the photosensitive drum 63 is primarily transferred to the intermediate transfer belt 44.

As described above, the intermediate transfer belt unit 30 is provided for primarily transferring the toner images formed with the image forming portion 66 to the intermediate transfer belt 44. After the toner images are primarily transferred, the intermediate transfer belt unit 30 transports the toner images to a secondary transfer portion 47. The secondary transfer portion 47 includes the secondary transfer roller 46, so that the toner images primarily transferred to the intermediate transfer belt 44 are secondarily transferred to the recording sheet 71 supplied from the sheet supply cassette 11.

In the first embodiment, the printer 1 further includes a fixing device 62. The fixing device 62 includes an upper roller 62*a* driven by the drive source (not shown) to rotate, and a lower roller 62*b* pressed against the upper roller 62*a* to follow the upper roller 62*a* and rotate. The fixing device 62 is configured such that the recording sheet 71 transported from the secondary transfer portion 47 is sandwiched at a nip portion between the upper roller 62*a* and the lower roller 62*b*, so that the recording sheet 71 is transported at a specific transportation speed (described later). When the fixing device 62 transports the recording sheet 71, heat and pressure are applied to the toner images on the recording sheet 71 to melt the toner images, so that the toner images thus melt are fixed to the recording sheet 71.

In the first embodiment, the printer 1 further includes a first separator 51, a reprinting transportation unit 32, a facedown stacker 72, and discharge roller pairs 16 to 20. The first separator 51 is disposed at a discharge position indicated with a broken line in FIG. 1 and a reprinting position indicated with a solid line in FIG. 1. At the discharge position, the first separator 51 guides the recording sheet 71 transported with the discharge roller pair 16 to the discharge roller pairs 17 to 20. At the reprinting position, the first separator 51 guides the recording sheet 71 to the reprinting transportation unit 32. The discharge roller pairs 17 to 20 are provided for discharging the recording sheet 71 guided with the first separator 51 to the facedown stacker 72.

In the first embodiment, the reprinting transportation unit 32 includes a second separator 52 for guiding the recording sheet 71 guided with the first separator 51 disposed at the reprinting position; a forward rotation roller pair 21 for transporting the recording sheet 71 in a forward direction and a backward direction if necessary; a third separator 53 for guiding the recording sheet 71; a two-pass transportation roller pair 22 for transporting the recording sheet 71 for a two-pass printing operation; a duplex printing transportation roller pair 23 for transporting the recording sheet 71 for a duplex printing operation; reprinting transportation roller pairs 24, 25, and 26 for transporting the recording sheet 71 toward the timing roller pair 15 once again; and a retracting portion 27 for temporarily storing the recording sheet 71 during the duplex printing operation.

In the first embodiment, it should be noted that the reprinting transportation unit 32 may be configured as a unit. Further, a transportation drive motor (not shown) is provided for transmitting a drive force to each of the roller pairs through a drive transmission portion (not shown). A solenoid (not shown) is provided for transmitting a drive force to the first separator 51, the second separator 52, and the third separator 53 through a moving transmission portion (not shown), so that the first separator 51, the second separator 52, and the third separator 53 are rotated to the specific position.

An operation of the reprinting transportation unit 32 having the configuration described above for transporting the recording sheet 71 during the two-pass printing operation will be explained next.

After a first-pass printing operation (the first printing operation) is performed on the recording sheet 71, the second separator 52 is set to a guiding position indicated with a solid line in FIG. 1. Further, the third separator 53 is set to a two-pass printing position indicated with a solid line in FIG. 1. Further, the forward rotation roller pair 21 is rotated in the forward direction and the reverse direction. Accordingly, the recording sheet 71 is transported into a two-pass printing path 28.

After the recording sheet 71 is transported to the two-pass printing path 28, the two-pass transportation roller pair 22, the reprinting transportation roller pair 24, the reprinting transportation roller pair 25, and the reprinting transportation roller pair 26 transport the recording sheet 71 in an arrow direction C. Accordingly, a surface of the recording sheet 71 (a front surface) that is printed in the first-pass printing operation becomes an upper surface (a printing surface), and the recording sheet 71 is transported to the timing roller pair 15 once again, so that a second-pass printing operation (the second printing operation to be performed on the same surface of the recording sheet 71) is performed. At this moment, the first separator 51 is set to the discharge position indicated with the broken line in FIG. 1. After the second-pass printing operation is performed on the recording sheet 71, the discharge roller pair 16, the discharge roller pair 17, the discharge roller pair 18, the discharge roller pair 19, and the discharge roller pair 20 transport and discharge the recording sheet 71 to a facedown stacker 72.

In the first embodiment, it should be noted that, in the first-pass printing operation, a color image printing operation is performed, in which the toner images formed with the ID units 61Y, 61M, 61C, and 61K are sequentially overlapped to form a color toner image. In the second-pass printing operation, a transparent image printing operation is performed, in which the transparent toner image formed with the ID unit 61T is printed on the color image.

An operation of the reprinting transportation unit 32 having the configuration described above for transporting the recording sheet 71 during the duplex printing operation will be explained next.

After the printing operation is performed on one surface of the recording sheet 71, the second separator 52 is set to the guiding position indicated with the solid line in FIG. 1. Further, the third separator 53 is set to a duplex printing position indicated with a broken line in FIG. 1. Further, the forward rotation roller pair 21 is rotated in the forward direction and the reverse direction. Accordingly, the recording sheet 71 is transported into the retracting portion 27 from a leading edge thereof.

After a trailing edge of the recording sheet 71 passes through the second separator 52, when the second separator 52, for example, detects the trailing edge of the recording sheet 71, the forward rotation roller pair 21 is revered and rotated in a drawing out direction while sandwiching the trailing edge of the recording sheet 71. At the same time, the second separator 52 is disposed at the guiding position indicated with the broken line in FIG. 1.

Accordingly, after a substantially entire portion of the recording sheet 71 is temporarily retained in the retracting portion 27, the recording sheet 71 is revered front-to-back and guided into a duplex printing path 29. Then, the duplex printing transportation roller pair 23, the reprinting transportation roller pair 24, the reprinting transportation roller pair 25, and the reprinting transportation roller pair 26 transport the recording sheet 71 in the arrow direction C. Accordingly, the backside surface of the recording sheet 71, where the printing operation is not yet performed, becomes the upper surface (the printing surface). Once again, the recording sheet 71 reaches the timing roller pair 15, and the printing operation is performed on the backside surface of the recording sheet 71 similarly to the front side surface thereof. At this moment, the first separator 51 is disposed at the discharge position indicated with the broken line in FIG. 1. Accordingly, after the printing operation is performed on both side surfaces of the recording sheet 71, the discharge roller pair 16, the discharge roller pair 17, the discharge roller pair 18, the discharge roller pair 19, and the discharge roller pair 20 transport and discharge the recording sheet 71 into the facedown stacker 72.

Figure 2:
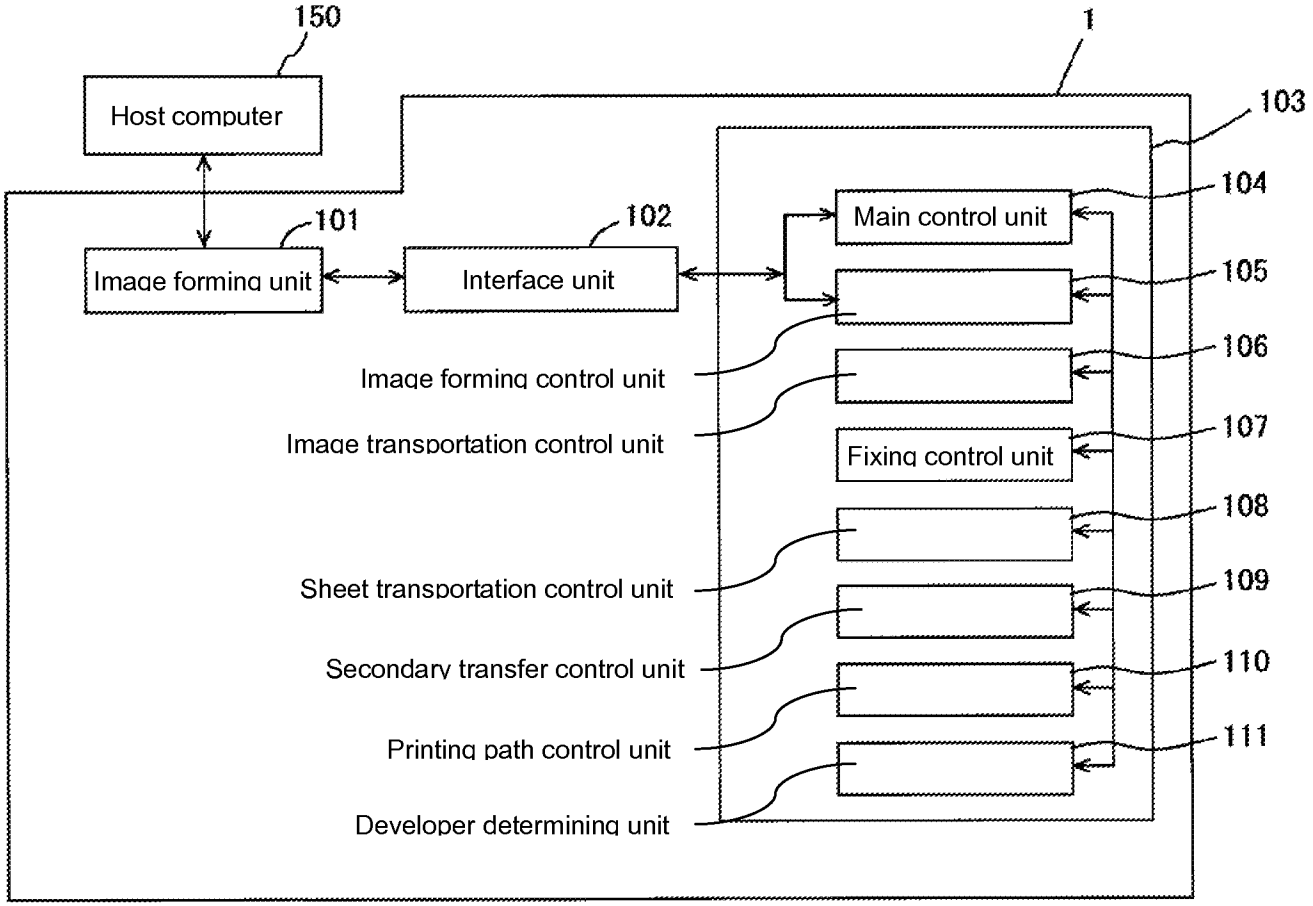
FIG. 2 is a block diagram showing a primary configuration of the printer according to the first embodiment of the present invention.

FIG. 2 is a block diagram showing a primary configuration of the printer 1 according to the first embodiment of the present invention. The primary configuration of the printer 1 will be explained next with reference to FIGS. 1 and 2.

As shown in FIG. 2, the printer 1 includes an image forming unit 101 for receiving print information from an external host computer 150, and analyzing the print information thus received; an engine control unit 103 for controlling an engine operation; and an interface unit 102 for receiving necessary information for controlling the engine operation, and communicating with the engine control unit 103.

In the first embodiment, the engine control unit 103 includes a main control unit 104 for instructing an operation processing for forming an image according to information transmitted from the interface unit 102; an image forming control unit 105 for driving and controlling an image forming operation; an image transportation control unit 106 for driving and controlling transportation of the image thus formed; a fixing control unit 107 for controlling a fixing temperature and the like; a sheet transportation control unit 108 for monitoring a position of a sheet, and driving and controlling transportation of the sheet; a secondary transfer control unit 109 for controlling the secondary transfer operation; a printing path control unit 110 for driving and controlling the first separator 51, the second separator 52, and the third separator 53 to move to the positions thereof; and a developer determining unit 111 for comparing developer in the first-pass printing operation and the second-pass printing operation, and determining a difference thereof.

In the first embodiment, the image forming unit 101 is configured to receive the print information from the host computer 100 to generate a print image, and transmits the print image to the engine control unit 103 through the interface unit 102. The main control unit 104 is configured to instruct the operation processing to the image forming control unit 105, the image transportation control unit 106, the fixing control unit 107, the sheet transportation control unit 108, the secondary transfer control unit 109, and the printing path control unit 110 for forming an image.

In the first embodiment, the image forming control unit 105 is configured to control the ID units 61, the LED heads 67, and the like of the image forming portion 66 to form the toner images on the photosensitive drum 63. The image transportation control unit 106 is configured to control the intermediate transfer belt unit 30, so that the toner images formed with the image forming control unit 105 are transferred to the intermediate transfer belt 44 and transported to the secondary transfer portion 47. The sheet transportation control unit 108 is configured to control the transportation and the transportation speed of the recording sheet 71 with all the rollers and the fixing device 62.

In the first embodiment, when the facedown stacker 72 controlled and transported with the sheet transportation control unit 108 and the toner images controlled and transported with the image transportation control unit 106 reach the secondary transfer portion 47, the secondary transfer control unit 109 is configured to control the secondary transfer portion 47 to secondarily transfer the toner images to the recording sheet 71. The fixing control unit 107 is configured to control the fixing device 62 to maintain the fixing temperature at a constant value, and apply head and pressure to the toner images on the recording sheet 71 to melt, so that the toner images are fixed to the recording sheet 71.

In the first embodiment, the printing path control unit 110 is configured to control the first separator 51, the second separator 52, and the third separator 53 to set the transportation path of the recording sheet 71 in the two-pass printing operation and the duplex printing operation. The developer determining unit 111 is configured to determine contents of developer (the difference of developer) to be used in the first-pass printing operation and the second-pass printing operation according to the print information.

It should be noted that the intermediate transfer belt unit 30, the secondary transfer portion 47, the image forming portion 66, the image forming control unit 105, the image transportation control unit 106, and the secondary transfer control unit 109 correspond to a developer image forming portion. Further, the fixing device 62 and the recording sheet 71 correspond to a fixing portion. Further, the timing roller pair 15, the reprinting transportation unit 32, the first separator 51, the sheet transportation control unit 108, and the printing path control unit 110 correspond to a transportation speed setting portion.

Figure 3:
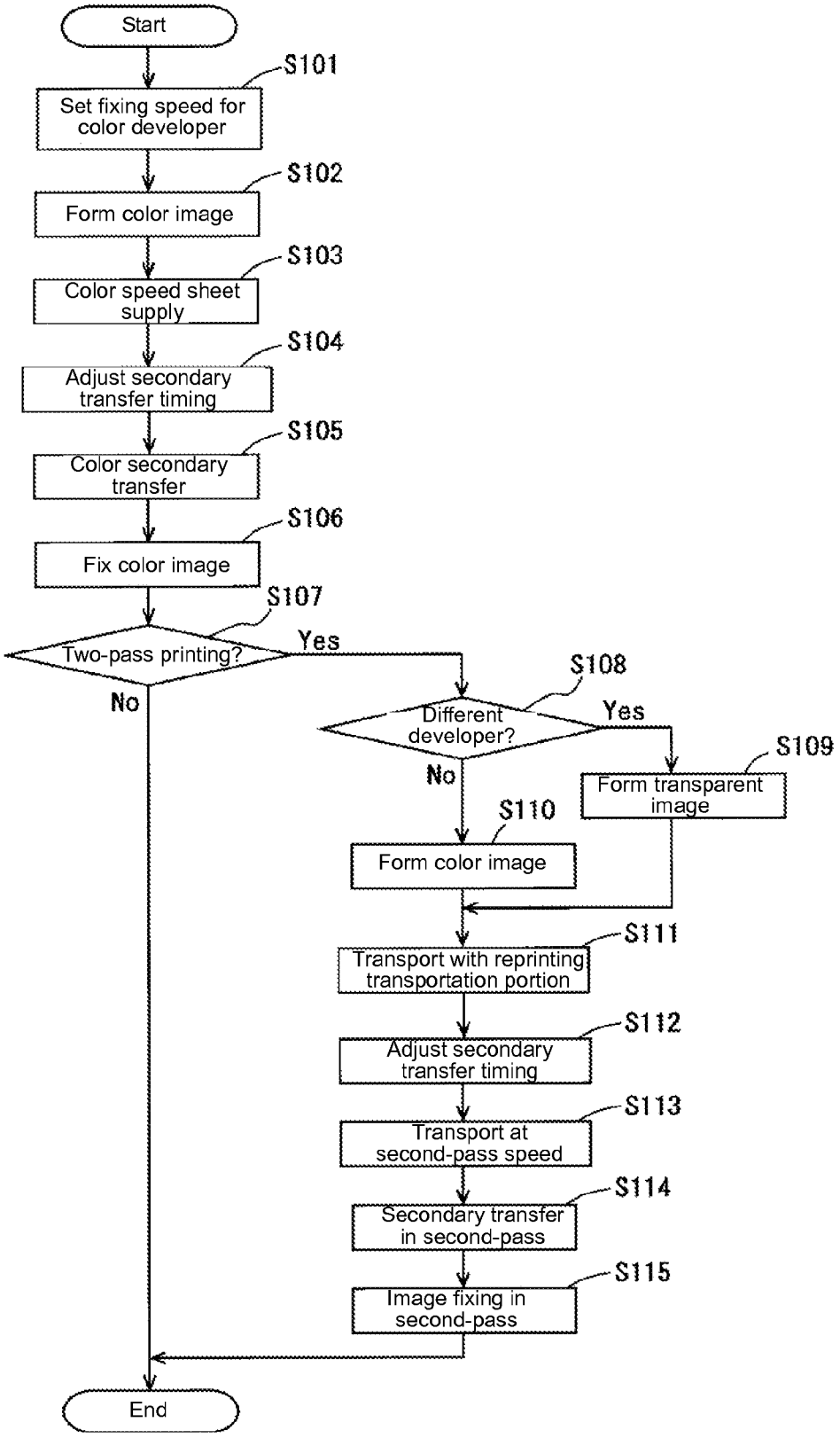
FIG. 3 is a flow chart showing a printing operation of the printer according to the first embodiment of the present invention.

An example of the printing operation of the printer 1 will be explained next with reference to a flowchart shown in FIG. 3, and FIGS. 1 and 2. FIG. 3 is the flow chart showing the printing operation of the printer 1 according to the first embodiment of the present invention.

When the main control unit 104 receives the print information, the main control unit 104 instructs the fixing control unit 107 and the sheet transportation control unit 108 to perform the printing operation of color developer. Accordingly, the fixing control unit 107 sets the temperature of the upper roller 62*a* of the fixing device 62 at the fixing temperature for color developer (for example, 165° C.). Further, in step S101, the sheet transportation control unit 108 controls the upper roller 62*a* to rotate, so that the recording sheet 71 is transported at a speed for color developer (for example, a liner speed of 239 mm/sec.)

In step S102, the main control unit 104 instructs the image forming control unit 105 and the image transportation control unit 106 to perform the printing operation of color developer. Accordingly, the image forming control unit 105 controls the image forming portion 66 to form the toner images in black (K), yellow (Y), magenta (M), and cyan (C). Further, the image transportation control unit 106 controls the intermediate transfer belt unit 30 to transport the color toner images formed with the image forming portion 66 at the speed for color developer.

When the image forming operation is started, the main control unit 104 instructs the sheet transportation control unit 108 to supply and transport the recording sheet 71 at the speed for color developer. Accordingly, in step S103, the sheet transportation control unit 108 drives the sheet supply roller pair 12, the register roller pair 13, and the register roller pair 14 to supply and transport the recording sheet 71 at the speed for color developer. In step S104, when the recording sheet 71 is transported to the timing roller pair 15, the sheet transportation control unit 108 adjusts the transportation timing, so that the positions of the color toner images transported with the intermediate transfer belt 44 are aligned with the position of the recording sheet 71 at the secondary transfer portion 47.

In step S105, when the recording sheet 71 is transported to the secondary transfer portion 47, the secondary transfer control unit 109 performs the secondary transfer operation with the secondary transfer roller 46, so that the color toner images are transferred to the recording sheet 71. In step S106, after the secondary transfer operation is performed, the fixing device 62 fixes the color toner images to the recording sheet 71. In step S107, when the recording sheet 71 is transported to the discharge roller pair 16, the main control unit 104 determines whether the two-pass printing operation is instructed according to the print information.

It should be noted that the secondary transfer operation and the fixing operation are preformed on the recording sheet 71 in parallel. In other words, when the leading edge of the recording sheet 71 is transported to the secondary transfer roller 46, the secondary transfer operation is started. After the secondary transfer operation is performed, when the leading edge of the recording sheet 71 is transported to the nip portion between the upper roller 62*a* and the lower roller 62*b* of the fixing device 62, the fixing operation is started. Accordingly, at this member, the fixing operation is performed on the leading edge of the recording sheet 71, and the trailing edge of the recording sheet 71 is still waiting for the secondary transfer operation. Afterward, when the trailing edge of the recording sheet 71 passes through the secondary transfer roller 46, the secondary transfer operation is completed. Further, when the trailing edge of the recording sheet 71 passes through the nip portion of the fixing device 62, the fixing operation is completed.

When the main control unit 104 determines that the two-pass printing operation is not instructed (No in step S107), the main control unit 104 sets the first separator 51 at the discharge position indicated with the broken line in FIG. 1 through the printing path control unit 110, so that the recording sheet 71, on which the first-pass printing operation is performed, is discharged to the facedown stacker 72.

On the other hand, when the main control unit 104 determines that the two-pass printing operation is instructed (Yes in step S107), the main control unit 104 sets the first separator 51 at the reprinting position indicated with the solid line in FIG. 1 through the printing path control unit 110. Further, the main control unit 104 sets the second separator 52 at the guiding position indicated with the solid line in FIG. 1, and sets the third separator 53 at the two-pass printing position indicated with the solid line in FIG. 1 through the printing path control unit 110. Accordingly, the recording sheet 71, on which the first-pass printing operation is performed, is transported to the reprinting transportation unit 32.

In step S108, the sheet supply cassette 11 determines whether developer to be used in the second-pass printing operation is different from developer used in the first-pass printing operation according to the print information. In the following description, as an example, it is supposed that color developer of four color toner is used in the first-pass printing operation, and transparent developer is used in the second-pass printing operation when the sheet supply cassette 11 determines that developer to be used in the second-pass printing operation is different from developer used in the first-pass printing operation according to the print information.

It should be noted that when transparent developer is used, in order to coat an entire area of the recording sheet 71 to obtain sufficient gloss, it is necessary to apply a larger amount of heat per unit area as compared with color developer. In order to increase an amount of heat, it may be configured such that the upper roller 62*a* of the fixing device 62 is set at a higher temperature than that in the first-pass printing operation. In this case, however, it may take a longer time to stabilize the temperature of the upper roller 62*a*. For this reason, in the example, the transportation speed is adjusted to a slower speed (for example, a linear speed of 215 mm/sec.) than the speed for color developer (for example, a linear speed of 239 mm/sec.) in the first-pass printing operation. Accordingly, it is possible to apply a larger amount of heat per unit area as compared with color developer.

When the sheet supply cassette 11 determines that developer to be used in the second-pass printing operation is not different from developer used in the first-pass printing operation (No in step S108), that is, the color printing operation is performed in the second-pass printing operation, it is not necessary to change the transportation speed. Accordingly, in step S110, the image forming control unit 105 and the image transportation control unit 106 start forming the color toner images with the image forming portion 66 and transporting the color toner images with the intermediate transfer belt unit 30 at the speed for color developer in the second-pass printing operation.

On the other hand, when the sheet supply cassette 11 determines that developer to be used in the second-pass printing operation is different from developer used in the first-pass printing operation (Yes in step S108), transparent developer is used in the second-pass printing operation. Accordingly, in step S109, the image forming control unit 105 and the image transportation control unit 106 start forming the transparent toner image with the image forming portion 66 and transporting the transparent toner image with the intermediate transfer belt unit 30 at the speed for transparent developer in the second-pass printing operation after the fixing operation is completed in the first-pass printing operation.

In step S111, the sheet transportation control unit 108 controls the forward rotation roller pair 21 to rotate in the forward direction, so that the recording sheet 71 transported into the reprinting transportation unit 32 is transported to the two-pass printing path 28. Further, the sheet transportation control unit 108 drives the two-pass transportation roller pair 22, the reprinting transportation roller pair 24, the reprinting transportation roller pair 25, and the reprinting transportation roller pair 26 to transport the recording sheet 71 in the arrow direction C, so that the recording sheet 71 is transported to the timing roller pair 15 once again.

At this moment, when the trailing edge of the recording sheet 71 passes through the discharge roller pair 16, the forward rotation roller pair 21, the two-pass transportation roller pair 22, the reprinting transportation roller pair 24, the reprinting transportation roller pair 25, and the reprinting transportation roller pair 26 transport the recording sheet 71 at the transportation speed in the second-pass printing operation (the speed for color developer or the speed for transparent developer). In step S112, when the leading edge of the recording sheet 71 reaches the reprinting transportation roller pair 26, the timing is approximately adjusted such that the leading edge of the recording sheet 71 is aligned with the toner images in the second-pass printing operation (the color toner images or the transparent toner image) at the secondary transfer portion 79. Then, the recording sheet 71 is transported to the timing roller pair 15.

In step S113, after the recording sheet 71 is transported out from the reprinting transportation unit 32, the main control unit 104 instructs the sheet transportation control unit 108 to transport the recording sheet 71 at the transportation speed in the second-pass printing operation. Accordingly, the sheet transportation control unit 108 drives and controls the rollers, so that the roller pairs on the downstream side of the timing roller pair 15 and the upper roller 62*a* of the fixing device 62 transport the recording sheet 71 at the transportation speed in the second-pass printing operation. At this moment, the timing roller pair 15 adjusts the timing precisely such that the position of the recording sheet 71 is aligned with the toner images in the second-pass printing operation (the color toner images or the transparent toner image) transported with the intermediate transfer belt 44 at the secondary transfer portion 79.

In step S114, after the recording sheet 71 is transported to the secondary transfer portion 47, the secondary transfer control unit 109 performs the secondary transfer operation with the secondary transfer roller 46, so that the toner images in the second-pass printing operation are transferred to the recording sheet 71. In step S115, the main control unit 104 instructs the fixing control unit 107 to perform the fixing operation of the toner images in the second-pass printing operation at the transportation speed in the second-pass printing operation. Afterward, the main control unit 104 controls the printing path control unit 110 to set the first separator 51 at the discharge position indicated with the broken line in FIG. 1, so that the recording sheet 71 is discharged to the facedown stacker 72 after the second-pass printing operation is completed.

In the first embodiment, the color toner images are printed in the first-pass printing operation, and the transparent toner image is printed in the second-pass printing operation, and the present invention is not limited thereto. Alternatively, a base portion may be printed in the first-pass printing operation, and the color toner images may be printed in the second-pass printing operation. In this case, the base portion is printed using white developer. When the base portion is printed using white developer, a white image is formed on an entire portion of the recording sheet 71, and it is not necessary to apply a large amount of heat as opposed to the printing operation of the color image. Accordingly, the fixing speed (the transportation speed) in the first-pass printing operation for printing the white image is set to be higher than the fixing speed (the transportation speed) in the second-pass printing operation for printing the color images.

Further, in the first embodiment, developer used in the first-pass printing operation is different from developer used in the second-pass printing operation, and the present invention is not limited thereto. Alternatively, the number of toner may be different between the first-pass printing operation and the second-pass printing operation. For example, when the duplex printing operation is performed, the color printing operation may be performed on the front surface and the monochrome printing in, for example, black, may be performed on the backside surface. In this case, the amount of heat necessary for the fixing operation in the color printing operation is different from that in the monochrome printing. Accordingly, it is possible to set different printing speeds. More specifically, it is possible to set the higher printing speed in the second-pass printing operation than that in the first-pass printing operation.

Further, the fixing property of developer used for forming the image on the front surface may be different from that of developer used for forming the image on the backside surface, when the duplex printing operation is performed. In this case, it is possible to set a different fixing speed in the second-pass printing operation than that in the first-pass printing operation according to the fixing property.

Further, in the first embodiment, the printer 1 performs the printing operation with the intermediate transfer method, in which the toner images are transferred to the intermediate transfer belt 44, and the present invention is not limited thereto. Alternatively, the present invention may be applicable to various printing methods including a direct transfer method, in which an image is directly transferred to a recording sheet.

As described above, in the first embodiment, even when the amount of heat necessary for fixing the developer image is different between the first-pass printing operation and the second printing operation, the transportation speed of the recording sheet in the fixing operation is adjusted to obtain the sufficient amount of heat, thereby making it possible to prevent the fixing problem.

Second Embodiment

Figure 4:
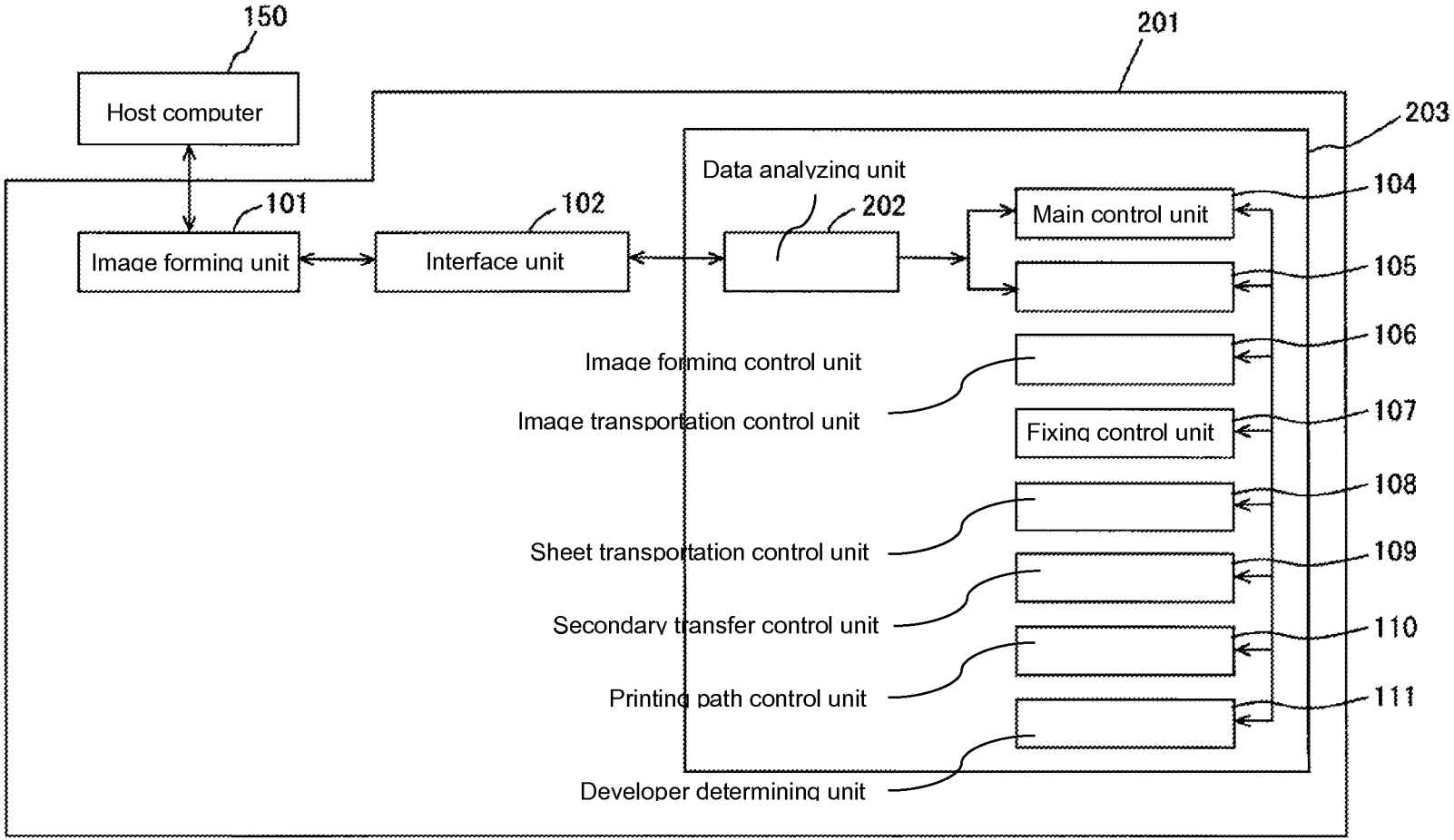
FIG. 4 is a block diagram showing a primary configuration of a printer according to a second embodiment of the present invention.
Figure 5:
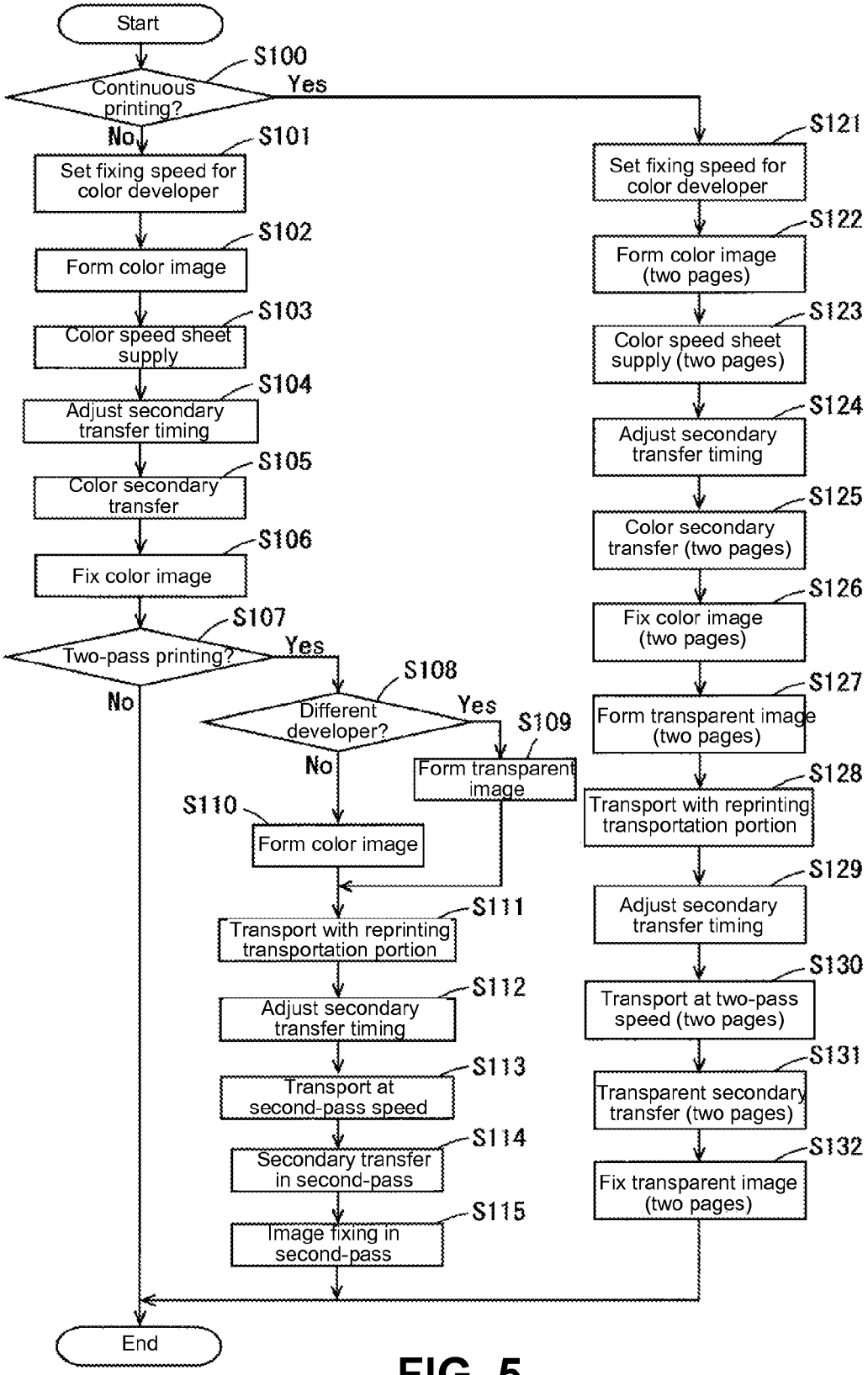
FIG. 5 is a flow chart showing a printing operation of the printer according to the second embodiment of the present invention.

A second embodiment of the present invention will be explained next. FIG. 4 is a block diagram showing a primary configuration of a printer 201 according to the second embodiment of the present invention. FIG. 5 is a flow chart showing a printing operation of the printer 201 according to the second embodiment of the present invention.

As shown in FIG. 4, different from the configuration of the printer 1 in the first embodiment, the printer 201 in the second embodiment includes an engine control unit 203. Further, the engine control unit 203 includes a data analyzing unit 202. Accordingly, components of the printer 201 similar to those of the printer 1 in the first embodiment are designated with the same reference numerals, and explanations thereof are omitted. In the following description, a difference from the first embodiment will be mainly explained. It should be noted that the primary configuration of the printer 201 is similar to that of the printer 1 shown in FIG. 1. Accordingly, the following description refers to FIG. 1 as needed.

In the printer 201 shown in FIG. 4, the data analyzing unit 202 is configured to analyze the print information transmitted from the interface unit 102. Further, the main control unit 104 is configured to instruct the operation processing for forming the image according to information transmitted from the data analyzing unit 202.

The printing operation of the printer 201 will be explained next with reference to the flow chart shown in FIG. 5 and FIGS. 1 and 4.

In step S100, when the data analyzing unit 202 receives the print information, the data analyzing unit 202 determines whether the color print information in the first-pass printing operation and the transparent print information in the second-pass printing operation are continuous over a plurality of pages (in the following description, it is supposed to print two pages of the recording sheet 71). It should be noted that the color print information includes the print information of black (K), yellow (Y), magenta (M), and cyan (C). When the data analyzing unit 202 determines that the color print information and the transparent print information are continuous (Yes in step S100), the process proceeds to step S121. When the data analyzing unit 202 determines that the color print information and the transparent print information are not continuous (No in step S100), the process proceeds to step S101.

It should be noted that, when the color print information in the first-pass printing operation and the transparent print information in the second-pass printing operation are transmitted alternately per one page, the printer 201 performs the process from step S101 to step S115 described in the first embodiment. The process is similar to that in the first embodiment, and an explanation thereof is omitted.

As described above, when the data analyzing unit 202 determines that the color print information and the transparent print information are continuous (Yes in step S100), the process proceeds to step S121. In step S121, when the main control unit 104 receives the print information, the main control unit 104 instructs the fixing control unit 107 and the sheet transportation control unit 108 to perform the printing operation of color developer. Accordingly, the fixing control unit 107 sets the temperature of the upper roller 62*a* of the fixing device 62 at the fixing temperature for color developer (for example, 165° C.). Further, the sheet transportation control unit 108 controls the upper roller 62*a* to rotate, so that the recording sheet 71 is transported at the speed for color developer (for example, a liner speed of 239 mm/sec.)

In step S122, the main control unit 104 instructs the image forming control unit 105 and the image transportation control unit 106 to perform the printing operation of color developer. Accordingly, the image forming control unit 105 controls the image forming portion 66 to form the toner images in black (K), yellow (Y), magenta (M), and cyan (C). In this case, the toner images are formed over two pages of the recording sheet 71 continuously transported. Further, the image transportation control unit 106 controls the intermediate transfer belt unit 30 to transport the color toner images formed with the image forming portion 66 at the speed for color developer.

When the image forming operation is started, the main control unit 104 instructs the sheet transportation control unit 108 to continuously supply and transport two pages of the recording sheet 71 at the speed for color developer. Accordingly, in step S123, the sheet transportation control unit 108 drives the sheet supply roller pair 12, the register roller pair 13, and the register roller pair 14 to supply and transport two pages of the recording sheet 71 at the speed for color developer. In step S124, when the recording sheet 71 is transported to the timing roller pair 15, the sheet transportation control unit 108 adjusts the transportation timing, so that the positions of the color toner images transported with the intermediate transfer belt 44 are aligned with the position of the recording sheet 71 at the secondary transfer portion 47.

In step S125, when the recording sheet 71 is transported to the secondary transfer portion 47, the secondary transfer control unit 109 performs the secondary transfer operation with the secondary transfer roller 46, so that the color toner images for two pages are transferred to corresponding two pages of the recording sheet 71 continuously transported. In step S106, after the secondary transfer operation is performed, the fixing device 62 fixes the color toner images to two pages of the recording sheet 71 continuously transported.

It should be noted that the secondary transfer operation and the fixing operation are preformed on the recording sheet 71 in parallel. In other words, when the leading edge of the recording sheet 71 is transported to the secondary transfer roller 46, the secondary transfer operation is started. After the secondary transfer operation is performed, when the leading edge of the recording sheet 71 is transported to the nip portion between the upper roller 62*a* and the lower roller 62*b* of the fixing device 62, the fixing operation is started. Accordingly, at this member, the fixing operation is performed on the leading edge of the recording sheet 71, and the trailing edge of the recording sheet 71 is still waiting for the secondary transfer operation. Afterward, when the trailing edge of the recording sheet 71 passes through the secondary transfer roller 46, the secondary transfer operation is completed. Further, when the trailing edge of the recording sheet 71 passes through the nip portion of the fixing device 62, the fixing operation is completed.

After the first-pass printing operation is completed through the fixing operation, the recording sheet 71 is transported to the discharge roller pair 16. At this moment, the printing path control unit 110 sets the first separator 51 at the reprinting position indicated with the solid line in FIG. 1. Further, the developer determining unit 1110 sets the second separator 52 at the guiding position indicated with the solid line in FIG. 1, and sets the third separator 53 at the two-pass printing position indicated with the solid line in FIG. 1. Accordingly, the recording sheet 71, on which the first-pass printing operation is performed, is transported to the reprinting transportation unit 32 with the transportation path defined in advance.

In step S127, the image forming control unit 105 and the image transportation control unit 106 start forming the transparent toner image with the image forming portion 66 and transporting the transparent toner image with the intermediate transfer belt unit 30 at the speed for transparent developer in the second-pass printing operation after the fixing operation is performed on the second page of the recording sheet 71. It should be noted that the transparent toner image is formed over two pages of the recording sheet 71. Then, the image transportation control unit 106 transports the transparent toner image formed with the image forming control unit 105 at the speed for transparent developer.

In step S128, the sheet transportation control unit 108 controls the forward rotation roller pair 21 to rotate in the forward direction, so that two pages of the recording sheet 71 sequentially transported into the reprinting transportation unit 32 are transported to the two-pass printing path 28. Further, the sheet transportation control unit 108 drives the two-pass transportation roller pair 22, the reprinting transportation roller pair 24, the reprinting transportation roller pair 25, and the reprinting transportation roller pair 26 to transport the recording sheet 71 in the arrow direction C, so that the recording sheet 71 is transported to the timing roller pair 15 once again.

In step S129, when the leading edge of the first page of the recording sheet 71 reaches the reprinting transportation roller pair 26, the forward rotation roller pair 21, the two-pass transportation roller pair 22, the reprinting transportation roller pair 24, the reprinting transportation roller pair 25, and the reprinting transportation roller pair 26 transport the recording sheet 71 at the timing approximately adjusted such that the leading edge of the recording sheet 71 is aligned with the toner images in the second-pass printing operation at the secondary transfer portion 79. Then, the recording sheet 71 is transported to the timing roller pair 15.

In step S130, after the first page of the recording sheet 71 is transported out from the reprinting transportation unit 32, the main control unit 104 instructs the sheet transportation control unit 108 to transport the recording sheet 71 at the transportation speed for transparent developer in the second-pass printing operation (for example, a linear speed of 15 mm/sec.). Accordingly, the sheet transportation control unit 108 drives and controls the rollers, so that the roller pairs on the downstream side of the timing roller pair 15 and the upper roller 62*a* of the fixing device 62 transport the recording sheet 71 at the transportation speed for transparent developer in the second-pass printing operation. At this moment, the timing roller pair 15 adjusts the timing precisely such that the position of the recording sheet 71 is aligned with the toner images in the second-pass printing operation transported with the intermediate transfer belt 44 at the secondary transfer portion 79.

In step S131, after two pages of the recording sheet 71 are sequentially transported to the secondary transfer portion 47, the secondary transfer control unit 109 performs the secondary transfer operation with the secondary transfer roller 46, so that the toner images in the second-pass printing operation are transferred to the recording sheet 71. In step S132, the main control unit 104 instructs the fixing control unit 107 to perform the fixing operation of the toner images in the second-pass printing operation at the transportation speed for transparent developer in the second-pass printing operation. Afterward, the main control unit 104 controls the main control unit 104 to set the first separator 51 at the discharge position indicated with the broken line in FIG. 1 through the printing path control unit 110, so that two sheets (two pages) of the recording sheet 71 are discharged to the facedown stacker 72 after the second-pass printing operation is completed.

Figure 6:
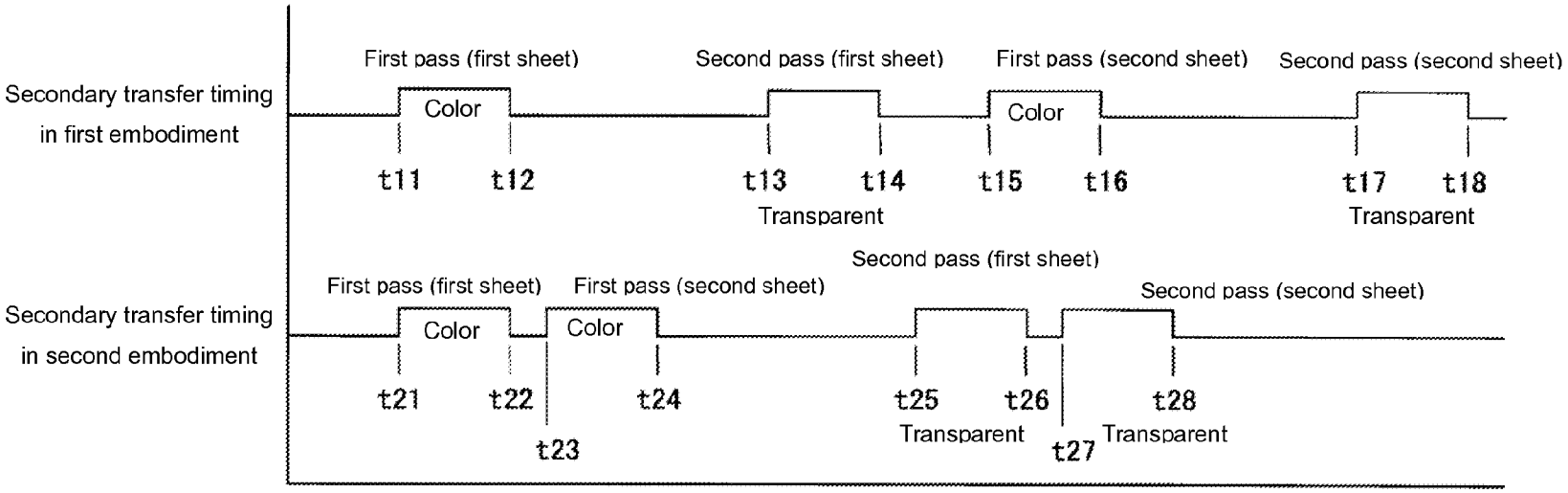
FIG. 6 is a timer chart showing a comparison between the printing operation of the printer according to the first embodiment of the present invention and the printing operation of the printer according to the second embodiment of the present invention.

FIG. 6 is a timer chart showing a comparison between the two-pass printing operation of the printer 1 per one page (one recording sheet) according to the first embodiment of the present invention and the two-pass printing operation of the printer 201 per two pages (two recording sheets) according to the second embodiment of the present invention.

When the color printing operation is performed in the first-pass and the transparent printing operation is performed in the second-pass, for example, the recording sheet 71 is transported through the reprinting transportation unit 32 from when the secondary transfer operation is completed in the first-pass to when the secondary transfer operation is performed in the second-pass. Further, the image forming operation in the second-pass is started after the transportation speed is switched after the fixing operation in the first-pass is completed. Accordingly, it is necessary to secure a specific preparation period.

In the first embodiment, when the two-pass printing operation is performed on two sheets of the recording sheet 71, for example, the color printing operation in the first-pass and the transparent printing operation in the second-pass are performed alternately per one sheet. Accordingly, as shown in FIG. 6, it is necessary to secure the specific preparation period twice between the timing t12 and the timing t13 and between the timing t16 and the timing t17 until the two-pass printing operation is completed on two sheets of the recording sheet 71. Further, it is necessary to secure a preparation period (between the timing t14 and the timing t15) between the first-pass printing operation and the second-pass printing operation for switching the transportation speed.

On the other hand, in the second embodiment, when the two-pass printing operation is performed on two sheets of the recording sheet 71, the color printing operation on the first sheet (in the first-pass) and the color printing operation on the second sheet (in the second-pass) are performed continuously. Further, the transparent printing operation on the first sheet (in the first-pass) and the transparent printing operation on the second sheet (in the second-pass) are also performed continuously. Accordingly, it is possible to reduce the specific preparation period to once between the timing t24 and the timing t25. Further, it is possible to shorten the period between the first-pass printing operation and the second-pass printing operation (between the timing t22 and the timing t23 and between the timing t26 and the timing t27), during which it is not necessary to change the transportation speed.

In the second embodiment, it is supposed that the reprinting transportation unit 32 is capable of stacking two pages of the recording sheet 71, and the two pages of the recording sheet 71 are continuously processed. The present invention is not limited to the example. Alternatively, the reprinting transportation unit 32 may be configured to be able to stack the N-number sheets (N is greater than three), so that the N-number sheets can be continuously processed. Accordingly, it is possible to further increase the processing time of the two-pass printing operation.

As described above, in the second embodiment, the printing operation using the same developer is performed continuously. Accordingly, in addition to the effects in the first embodiment, it is possible to further improve through put.

In the first embodiment and the second embodiment described above, the color electro-photographic printer is explained as the example, and the present invention is not limited thereto. Alternatively, the present invention may be applicable to an image forming apparatus such as a copier, a facsimile, and an MFP (Multi Function Product) for forming an image using the electro-photographic method. Further, the present invention may be applicable to a monochrome printer.

The disclosure of Japanese Patent Application No. 2013-056939, filed on Mar. 19, 2013, is incorporated in the application.

While the invention has been explained with reference to the specific embodiments of the invention, the explanation is illustrative and the invention is limited only by the appended claims.

What is claimed is:

1. An image forming apparatus comprising:

a first unit configured to form a first developer image on a first recording medium and a second recording medium using first developer;

a second unit configured to form a second developer image on the first recording medium and the second recording medium using second developer different from the first developer;

a fixing portion configured to fix the first developer image and the second developer image to the first recording medium and the second recording medium;

a transportation portion configured to transport the first recording medium and the second recording medium to the first unit and the second unit; and a control portion configured to set a transportation speed of the first recording medium and the second recording medium when the fixing portion fixes the first developer image and the second developer image to the first recording medium and the second recording medium, wherein said transportation portion is configured to arrange the first recording medium and the second recording medium on a transportation path in a transportation direction of the first recording medium and the second recording medium, said control portion controls the first unit to continuously form the first developer image on one side surfaces of the first recording medium and the second recording medium, said control portion sets the transportation speed at a first transportation speed so that the fixing portion fixes the first developer image at the first transportation speed, said control portion sets the transportation speed at a second transportation speed different from the first transportation speed so that the fixing portion fixes the second developer image at the second transportation speed after the second unit continuously forms the second developer image on the one side surfaces of the first recording medium and the second recording medium, said first unit is configured to form the first developer image using white developer, and said second unit is configured to form the second developer image using developer in a plurality of colors.

2. An image forming apparatus comprising:

a developer image forming portion configured to form a first developer image and a second developer image on a recording medium;

a fixing portion configured to fix the first developer image and the second developer image to the recording medium; and a control portion configured to set a transportation speed of the recording medium at the fixing portion, wherein said control portion configured sets the transportation speed at a first transportation speed so that the fixing portion fixes the first developer image at the first transportation speed, said control portion sets the transportation speed at a second transportation speed slower than the first transportation speed so that the fixing portion fixes the second developer image at the second transportation speed, and said developer image forming portion forms the first developer image using white developer and the second developer image using developer in a color other than white.

3. The image forming apparatus according to claim 2, wherein said developer image forming portion is configured to form the first developer image and the second developer image on a same surface of the recording medium.

4. The image forming apparatus according to claim 1, wherein said second unit is configured to form the second developer image using black developer.

5. The image forming apparatus according to claim 1, wherein said second unit is configured to form the second developer image using developer with plurality of colors other than white developer.

6. The image forming apparatus according to claim 2, wherein said developer image forming portion includes a first unit configured to form the first developer image using white developer and a second unit configured to form the second developer image using color developer other than white developer.

* * * * *